US009048580B2

(12) United States Patent
Chien

(10) Patent No.: US 9,048,580 B2
(45) Date of Patent: Jun. 2, 2015

(54) EASY-PULL MALE NETWORK CONNECTOR AND TOOL COMBINATION

(71) Applicant: NINGBO EXCELLENCE COMMUNICATED CONNECTOR CO., LTD., Zhejiang (CN)

(72) Inventor: Chien-Hsun Chien, Taoyuan Hsien (TW)

(73) Assignee: NINGBO EXCELLENCE COMMUNICATED CONNECTOR CO., LTD., Zhejiang (CN)

( * ) Notice: Subject to any disclaimer, the term of this patent is extended or adjusted under 35 U.S.C. 154(b) by 0 days.

(21) Appl. No.: 14/493,708

(22) Filed: Sep. 23, 2014

(65) Prior Publication Data

US 2015/0079835 A1 Mar. 19, 2015

Related U.S. Application Data

(63) Continuation-in-part of application No. 14/029,398, filed on Sep. 17, 2013.

(51) Int. Cl.
*H01R 13/627* (2006.01)
*H01R 13/633* (2006.01)
*H01R 43/26* (2006.01)

(52) U.S. Cl.
CPC ..... *H01R 13/6335* (2013.01); *H01R 13/627* (2013.01); *H01R 43/26* (2013.01)

(58) Field of Classification Search
CPC ..... H01R 13/6272
USPC ..... 439/344, 352
See application file for complete search history.

(56) References Cited

U.S. PATENT DOCUMENTS

| | | | | |
|---|---|---|---|---|
| 4,548,455 | A * | 10/1985 | Ezure | 439/152 |
| 5,090,916 | A * | 2/1992 | Magnier | 439/352 |
| 6,371,787 | B1 * | 4/2002 | Branch et al. | 439/352 |
| 6,585,537 | B1 * | 7/2003 | Lee | 439/358 |
| 6,776,646 | B2 * | 8/2004 | Lee | 439/357 |
| 6,863,556 | B2 * | 3/2005 | Viklund et al. | 439/354 |
| 7,037,129 | B2 * | 5/2006 | Lo et al. | 439/352 |
| 7,297,013 | B2 * | 11/2007 | Caveney et al. | 439/352 |
| 7,465,180 | B2 * | 12/2008 | Kusuda et al. | 439/352 |
| 7,517,241 | B2 * | 4/2009 | Gundlach et al. | 439/352 |
| 7,901,237 | B2 * | 3/2011 | Abe et al. | 439/354 |
| 7,959,455 | B1 * | 6/2011 | Armstrong et al. | 439/354 |
| 8,187,018 | B2 * | 5/2012 | Kosugi | 439/344 |
| 8,632,352 | B2 * | 1/2014 | Wagner | 439/352 |
| 8,840,419 | B2 * | 9/2014 | Huang | 439/352 |
| 8,845,344 | B2 * | 9/2014 | Ishiyama | 439/133 |
| 2014/0377977 | A1 * | 12/2014 | Chien | 439/345 |

* cited by examiner

*Primary Examiner* — Neil Abrams
(74) *Attorney, Agent, or Firm* — Guice Patents PLLC

(57) ABSTRACT

An easy-pull male network connector includes a male connector body providing a resilient clip lockable to a mating female network connector, a protective jacket surrounding the male connector body, a bracket located at one end of the male connector body remote from the resilient clip, a pivotable hook pivotally mounted at the bracket and hooked on the resilient clip and biasable to release or press the resilient clip when the protective jacket is moved forwards or backwards relative to the male connector body, and a tool attachable to the protective jacket and operable to move the protective jacket backwards relative to the male connector body. Thus, when the user pulls the protective jacket backwards, either with the hand or by means of the tool, to press the resilient clip, the easy-pull male network connector is disengaged from the mating female network connector.

4 Claims, 8 Drawing Sheets

EASY-PULL MALE NETWORK CONNECTOR AND TOOL COMBINATION

CROSS REFERENCE TO RELATED ART

This Invention is a continuation-in-part of U.S. Ser. No. 14/029,398, entitled "Easy-Pull Male Network Connector " filed on Sep. 17, 2013 and currently pending.

BACKGROUND OF THE INVENTION

1. Field of the Invention

The present invention relates to electrical connector technology, and more particularly to an easy-pull male network connector that can be conveniently pulled out of the mating female network connector with less effort with selective assistance of a tool.

2. Description of the Related Art

A male network connector insertable into a mating female network connector for data transmission may be equipped with a safety structure made in the form of a resilient clip. A commercial male network connector is known comprising a male connector body electrically connected to one end of a cable, a protective jacket surrounding the male connector body around the cable, and a resilient clip located at one end of the male connector body. After insertion of the male network connector into an insertion hole of a mating female network connector, the resilient clip is forced into engagement with a retaining groove inside the insertion hole to lock the male network connector to the female network connector. When wishing to remove the male network connector from the female network connector, press down the resilient clip to disengage the resilient clip from the retaining groove and then pull the male network connector out of the insertion hole of the female network connector. However, if the female network connector is disposed in an area where the user's hand cannot access to the resilient clip of the male network connector conveniently, the user will be difficult to remove the male network connector from the female network connector.

U.S. application Ser. No. 14/029,398, filed by the present inventor, discloses an easy-pull male network connector that can be conveniently pulled out of the mating female network connector. This design of easy-pull male network connector is functional, however, it has a complicated structure with the use of a spring member.

SUMMARY OF THE INVENTION

The present invention has been accomplished under the circumstances in view. It is the main object of the present invention to provide an easy-pull network connector, which eliminates the drawbacks of the aforesaid prior art design.

It is another object of the present invention to provide an easy-pull network connector, which provides a tool for selective use by the user to pull the protective jacket in disengaging the resilient clip from the mating female network connector with less effort.

It is still another object of the present invention to provide an easy-pull network connector, which has the protective jacket be configured to provide a linking portion adapted for moving a bottom end portion of the pivotable hook to bias the pivotable hook relative to the bracket with less effort.

DETAILED DESCRIPTION OF THE INVENTION

Figure 1:
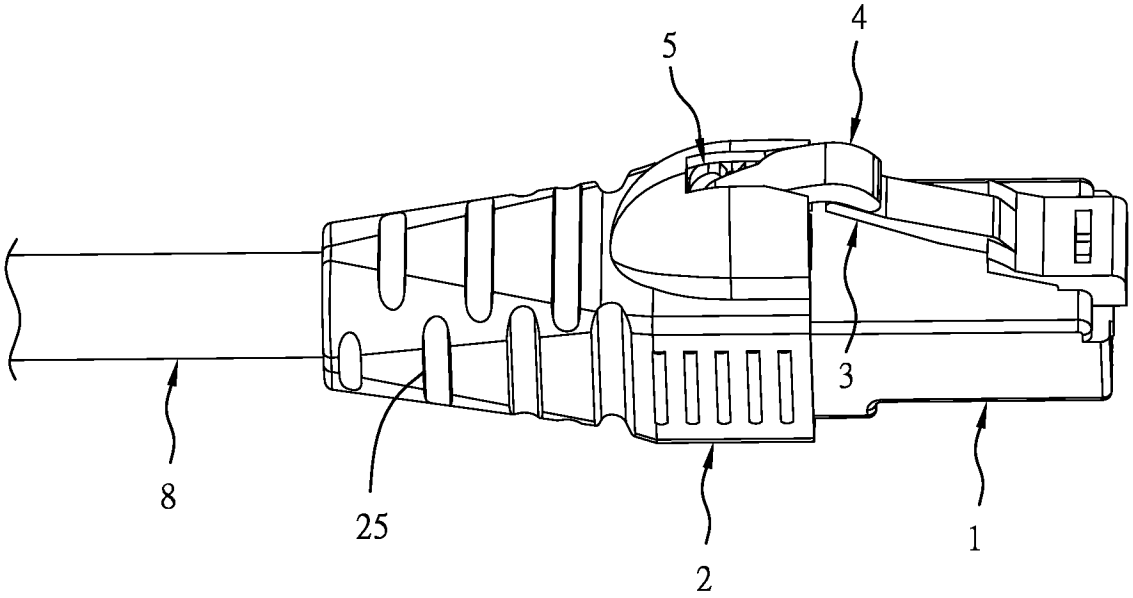
FIG. 1 is an oblique top elevational view of an easy-pull male network connector of an easy-pull network connector and tool combination in accordance with the present invention.
Figure 2:
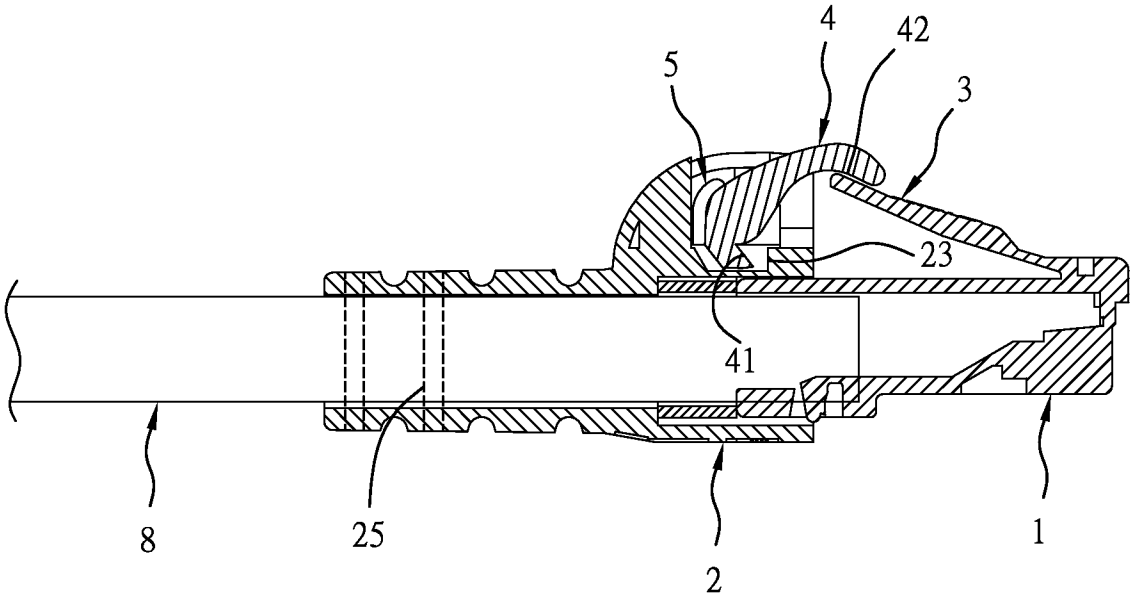
FIG. 2 is a longitudinal sectional view of the easy-pull male network connector of an easy-pull network connector and tool combination in accordance with the present invention.
Figure 5:
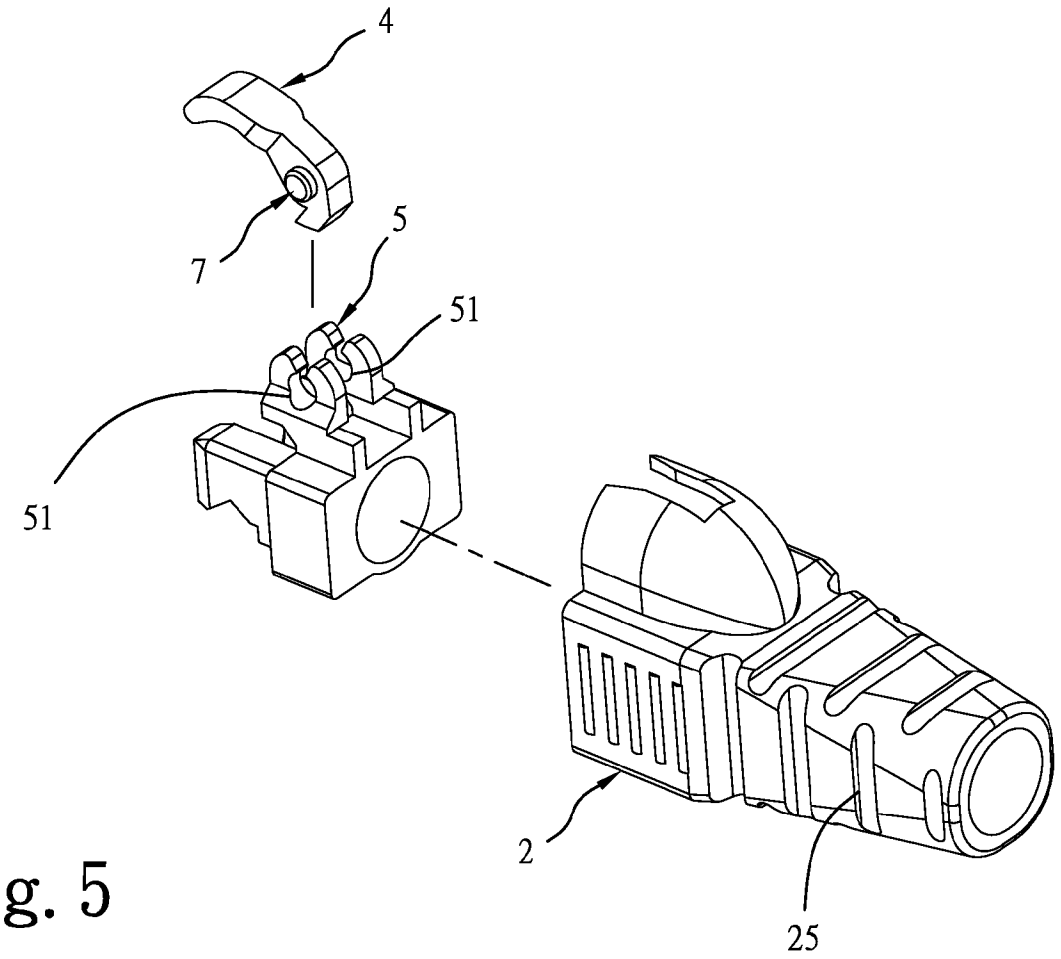
FIG. 5 is an exploded view of the pivotable hook, bracket and protective jacket of the easy-pull male network connector of the easy-pull network connector and tool combination in accordance with the present invention.

Referring to FIGS. 1, 2 and 5, an easy-pull male network connector in accordance with the present invention is shown. The easy-pull male network connector comprises a male connector body 1, and a protective jacket 2 movably mounted around the male connector body 1. The male connector body 1 is electrically connected to one end of a cable 8, comprising a resilient clip 3 located at a top side of one end thereof and a bracket 5 located at an opposite end thereof (see FIG. 2 and FIG. 5) and adapted to secure the protective jacket 2. Further, the cable 8 has its other end extending out of the protective jacket 2.

Figure 3:
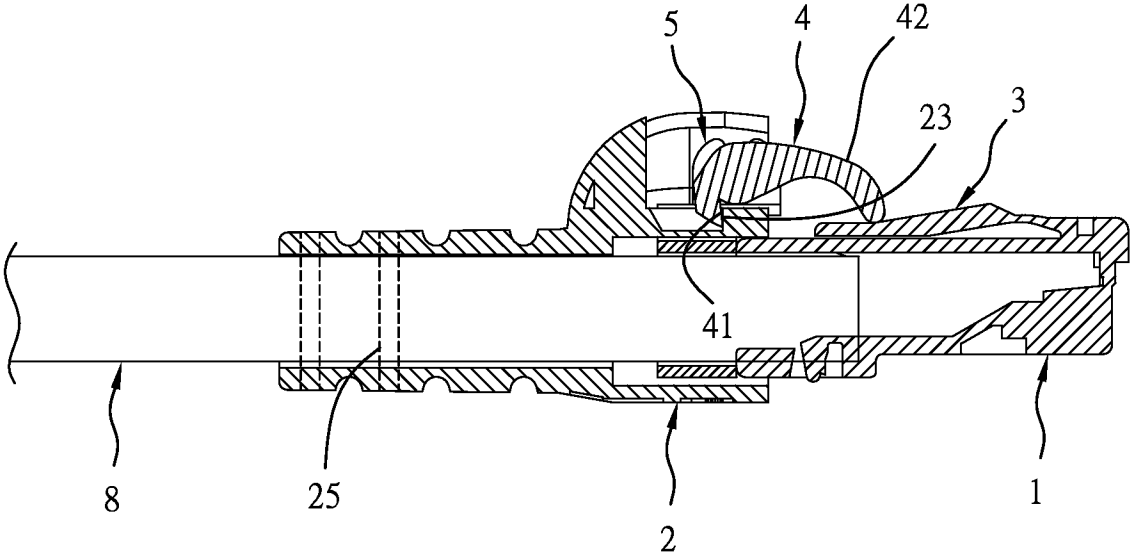
FIG. 3 is a schematic sectional operational view of the present invention, illustrating the protective jacket pulled backwards.
Figure 4:
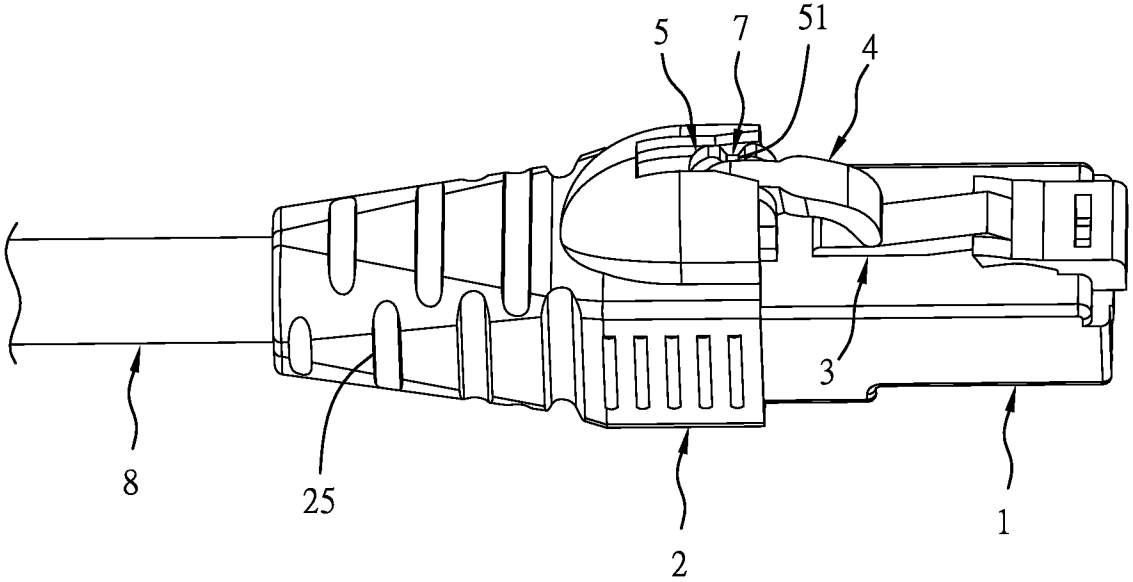
FIG. 4 is an oblique top elevational view of FIG. 3.

The main features of the present invention are outlined hereinafter:

The invention further comprises a pivotable hook 4 pivotally connected to a pivot hole 51 of the bracket 5 by a pivot pin 7 (see FIG. 4 and FIG. 5) for hooking on the resilient clip 3. The pivotable hook 4 has one end thereof terminating in a bottom end portion 41. The protective jacket 2 comprises a linking portion 23 adapted for moving the bottom end portion 41 of the pivotable hook 4 (see FIG. 2 and FIG. 3).

When going to remove the easy-pull male network connector from the mating female network connector, the user simply needs to pull the protective jacket 2 backwards. At this time, the linking portion 23 of the protective jacket 2 will be forced against the bottom end portion 41 of the pivotable hook 4 to bias the pivotable hook 4 relative to the bracket 5 in one direction, causing an opposing top end portion 42 of the pivotable hook 4 to be pressed on the resilient clip 3 (see FIG. 3 and FIG. 4), and thus, the resilient clip 3 is disengaged from the female network connector for allowing removal of the easy-pull male network connector from the mating female network connector. After the user released the hand from the protective jacket 2, the resilient clip 3 immediately returns to its former shape to return the protective jacket 2 to its former position (see FIG. 1 and FIG. 2).

Figure 6:
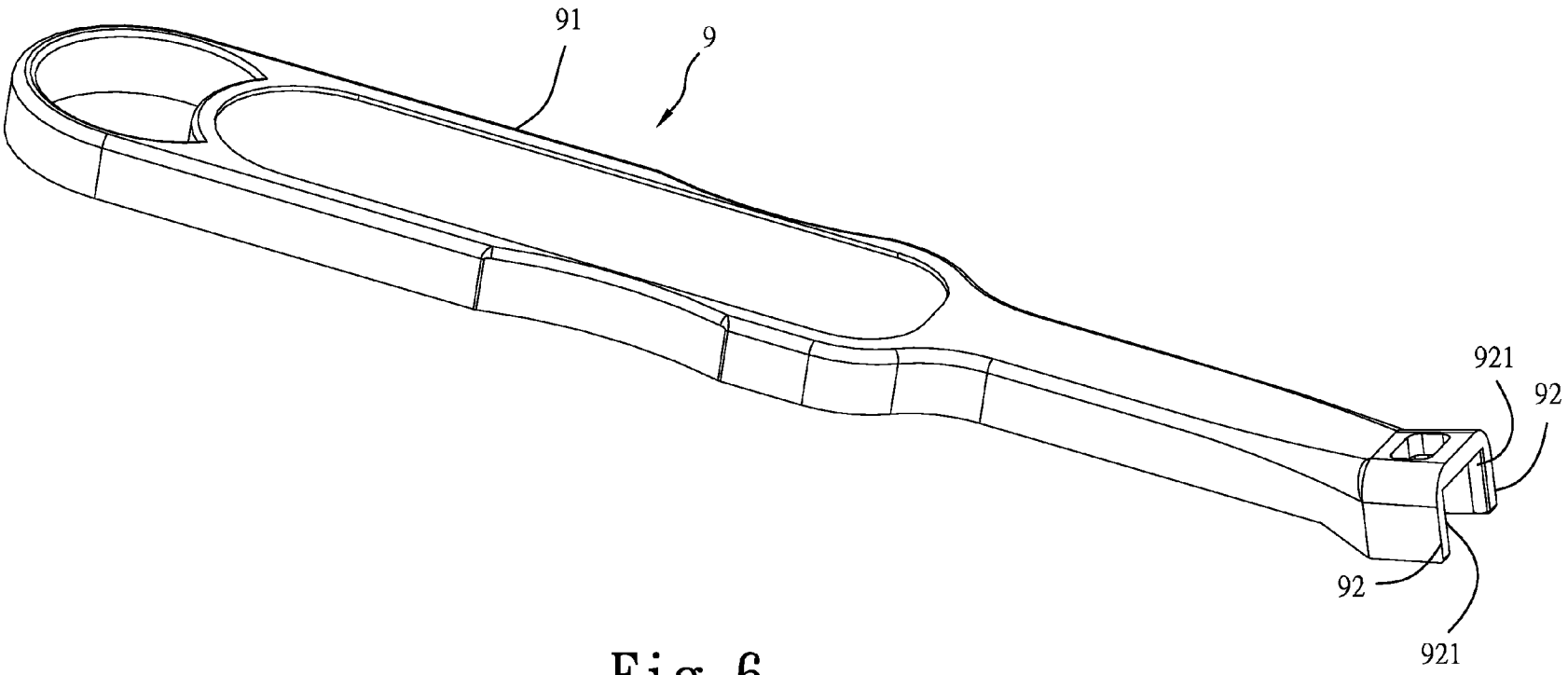
FIG. 6 is an oblique top elevational view of the tool of the easy-pull network connector and tool combination in accordance with the present invention.
Figure 7:
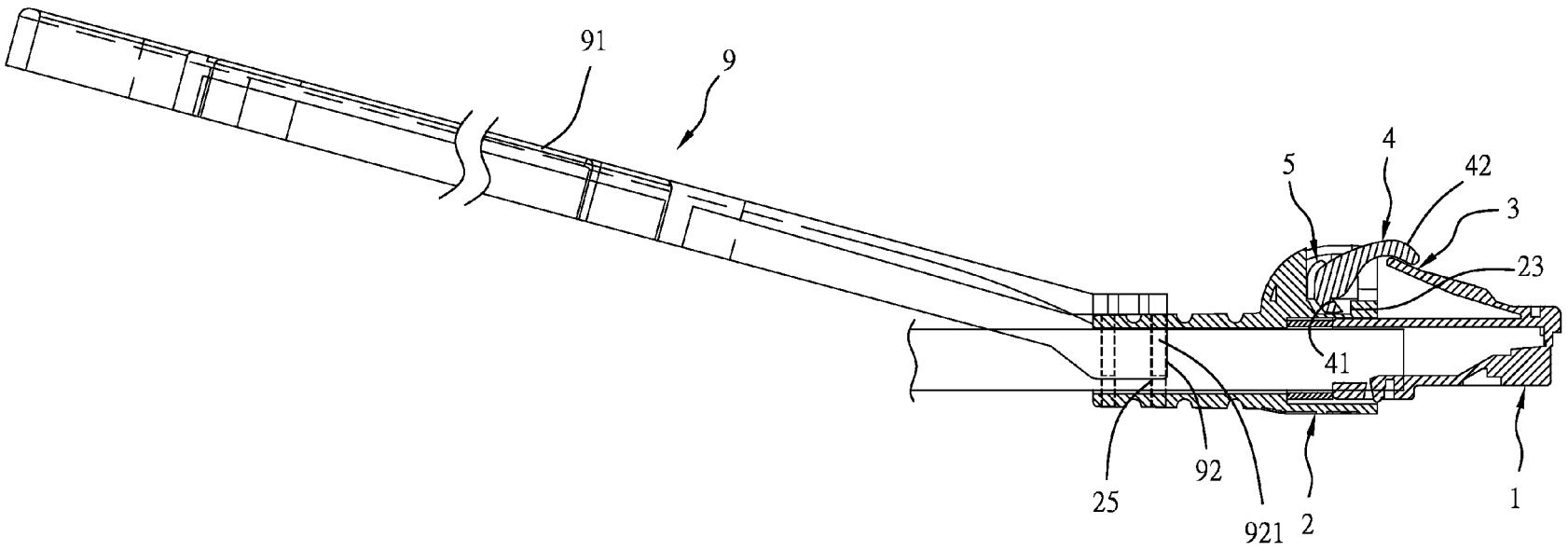
FIG. 7 is a schematic sectional applied view of the present invention, illustrating the tool attached to the protective jacket.
Figure 8:
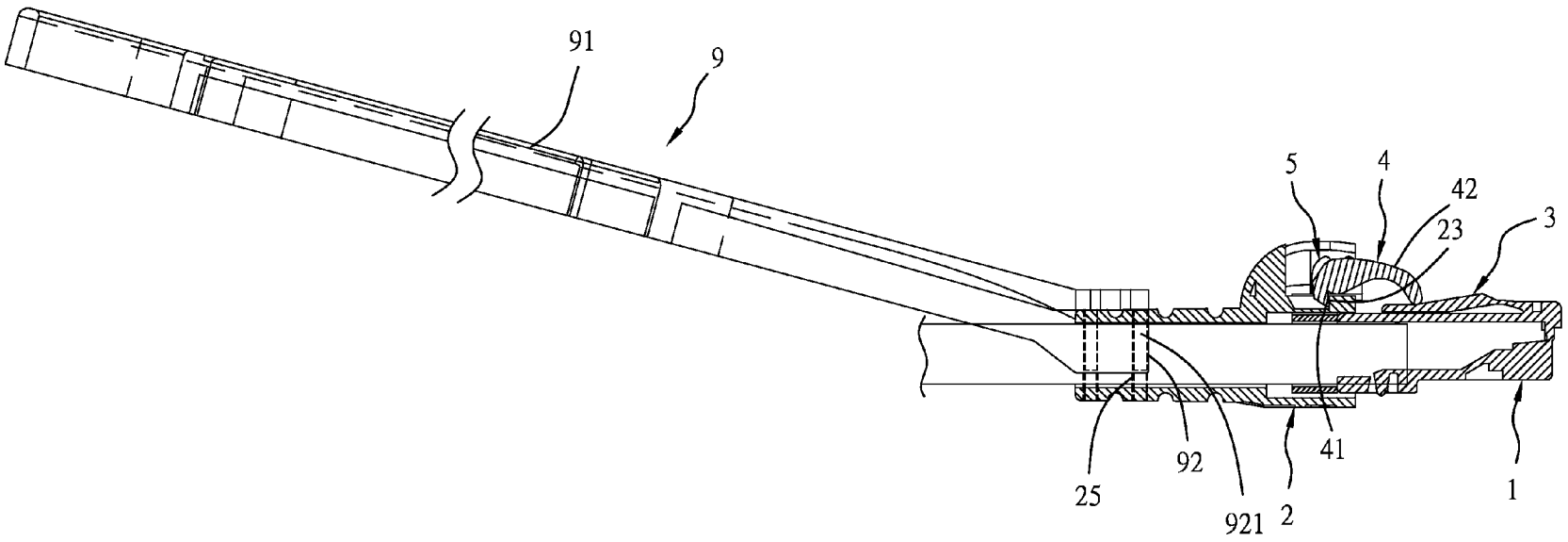
FIG. 8 corresponds to FIG. 7, illustrating the protective jacket moved backwards relative to the male connector body and the top end portion of the pivotable hook pressed on the resilient clip.

The invention further comprises a tool 9 (see FIG. 6) for selective use. The tool 9 comprises a handle 91, two end walls 92 bilaterally disposed at one end thereof for attaching to two opposite sidewalls of the protective jacket 2, and a plurality of engagement portions 921 respectively located cat an inner side of each of the end walls 92 (see FIGS. 6-8) for engaging into respective locating grooves 25 (see FIG. 5, FIG. 7, FIG. 8) at the sidewalls of the protective jacket 2, and thus, the user can operate the tool 9 to move the protective jacket 2 backward with less effort (see FIG. 8).

The simplifies the structural arrangement of the easy-pull male network connector without the use of a spring member, enabling the easy-pull male network connector to be conveniently pulled out of the mating female network connector with less effort.

The easy-pull male network connector of the invention has reasonable practicability and is easy to mount and dismount. Even if the easy-pull male network connector is disposed in an area where the user's hand cannot access to the resilient clip 3 at the male connector body 1, the user can still conveniently remove the easy-pull male network connector from the mating female network connector.

In conclusion, the invention provides an easy-pull network connector, which allows the user to bias the pivotable hook 4 in releasing or pressing the resilient clip 3 by means of moving the protective jacket 2 forward and backward, and thus the user can remove the easy-pull male network connector from the mating female network connector easily and rapidly. The invention also provide a tool 9 for selective use to move the protective jacket 2 in disengaging the resilient clip 3 from the mating female network connector.

What is claimed is:

1. An easy-pull male network connector and tool combination, comprising a male connector body electrically connected to one end of a cable, a protective jacket surrounding said male connector body around said cable, a resilient clip located at one end of said male connector body and adapted for locking said male connector body to a mating female network connector after insertion of said male connector body into an insertion hole in said mating female network connector, and a bracket located at an opposite end of said male connector body and adapted to secure said protective jacket to said male connector body, wherein the easy-pull male network connector further comprises a pivotable hook pivotally connected to a pivot hole of said bracket by a pivot pin for hooking on said resilient clip, said pivotable hook having one end thereof terminating in a bottom end portion; said protective jacket comprises a linking portion adapted for moving said bottom end portion of said pivotable hook, and thus, when said protective jacket is moved backwards relative to said bracket, said protective jacket is force to bias said pivotable hook relative to said bracket in imparting a downward pressure to said resilient clip; when the external pressure is released from said protective jacket, the elastic potential energy of said resilient clip immediately return said protective jacket.

2. The easy-pull male network connector and tool combination as claimed in claim 1, further comprising a tool attachable to said protective jacket and operable to move said protective jacket backwards relative to said male connector body, said tool comprising a handle, and a plurality of engagement portions located in one end thereof and engageable in respective locating grooves at two opposite sidewalls of said protective jacket.

3. The easy-pull male network connector and tool combination as claimed in claim 2, wherein said tool comprises two end walls bilaterally located at one end of said handle; said engagement portions of said tool are respectively located at an inner side of each of said two end walls.

4. An easy-pull male network connector and tool combination, comprising a male connector body electrically connected to one end of a cable, a protective jacket surrounding said male connector body around said cable, a resilient clip located at one end of said male connector body and adapted for locking said male connector body to a mating female network connector after insertion of said male connector body into an insertion hole in said mating female network connector, and a bracket located at an opposite end of said male connector body and adapted to secure said protective jacket to said male connector body, wherein the easy-pull male network connector further comprises a pivotable hook pivotally connected to a pivot hole of said bracket by a pivot pin for hooking on said resilient clip and a tool attachable to said protective jacket and operable to move said protective jacket backwards relative to said male connector body, said pivotable hook having one end thereof terminating in a bottom end portion, said protective jacket comprising a linking portion adapted for moving said bottom end portion of said pivotable hook in such a manner that when said protective jacket is moved backwards relative to said bracket, said protective jacket is force to bias said pivotable hook relative to said bracket in imparting a downward pressure to said resilient clip; when the external pressure is released from said protective jacket, the elastic potential energy of said resilient clip immediately return said protective jacket, said tool comprising a handle, and a plurality of engagement portions located in one end thereof and engageable in respective locating grooves at two opposite sidewalls of said protective jacket.

* * * * *